United States Patent [19]

Phelps

[11] 4,055,609

[45] Oct. 25, 1977

[54] CARBURETOR AND FUEL SUPPLY SYSTEM

[75] Inventor: Harold E. Phelps, Bellville, Mich.

[73] Assignee: Harold Phelps, Inc., Plymouth, Mich.

[21] Appl. No.: 642,015

[22] Filed: Dec. 18, 1975

Related U.S. Application Data

[63] Continuation-in-part of Ser. No. 534,274, Dec. 19, 1974, abandoned.

[51] Int. Cl.[2] ..... F02M 17/04

[52] U.S. Cl. ..... 261/36 A; 123/139 AW; 261/51; 261/DIG. 19; 261/DIG. 57; 261/DIG. 68; 417/380; 417/383

[58] Field of Search ..... 261/DIG. 19, 51, 36 A, 261/DIG. 68, 69 R, DIG. 57, 41 D; 417/380, 383; 415/182; 123/139 AW

[56] References Cited

U.S. PATENT DOCUMENTS

| | | | |
|---|---|---|---|
| 1,465,097 | 8/1923 | Sherzer | 415/182 |
| 2,728,564 | 12/1955 | Bracke | 261/DIG. 68 |
| 2,943,849 | 7/1960 | Csecs | 261/51 |
| 2,964,029 | 12/1960 | Tirloni | 261/23 A |
| 3,018,798 | 1/1962 | Bowlus | 251/335 R |
| 3,208,739 | 9/1965 | Phillips | 261/36 A |
| 3,252,498 | 5/1966 | Ball | 261/36 A |
| 3,262,433 | 7/1966 | Jordan | 261/36 A |
| 3,331,360 | 7/1967 | Fleming | 261/41 D |
| 3,339,881 | 9/1967 | Palmer | 251/335 R |
| 3,343,820 | 9/1967 | Elliott | 261/51 |
| 3,540,701 | 11/1970 | Brenneke et al. | 261/36 A |
| 3,608,587 | 9/1971 | Zbell | 251/84 |
| 3,610,213 | 10/1971 | Gianini | 123/139 AW |
| 3,642,256 | 2/1972 | Phelps | 261/51 |
| 3,738,336 | 6/1973 | Holland | 261/DIG. 68 |
| 3,746,320 | 7/1973 | Van Camp et al. | 261/DIG. 68 |
| 3,800,754 | 4/1974 | Carlson et al. | 123/139 AW |
| 3,800,770 | 4/1974 | Baribeau et al. | 261/51 |

*Primary Examiner*—Tim R. Miles

*Attorney, Agent, or Firm*—Fisher, Gerhard & Groh

[57] ABSTRACT

A carburetor and fuel feed device for small internal combustion engines incorporating a pumping section which receives fuel from a supply and delivers the required amounts for the range of operation between high and low speed operation with any excess being returned to the source of supply. A control device is employed which permits deceleration from high to low speed operation without flooding by instantaneously preventing the supply of fuel for high speed operation in response to movement of the throttle valve to an idle or low speed position.

13 Claims, 7 Drawing Figures

CARBURETOR AND FUEL SUPPLY SYSTEM

This is a continuation-in-part application of my pending application Ser. No. 534,274 filed Dec. 19,1974, now abandoned.

This invention relates to a combined carburetor and fuel feed device for small internal combustion engines.

In the operation of small internal combustion engines which are used with power tools such as chain saws and the like, the carburetor must be very small and compact and operate in all positions of the power tool and at the same time function in a sophisticated manner just as larger, full sized carburetors for larger internal combustion engines.

Conventionally, such carburetors and fuel feed systems employ a diaphragm pump which delivers fuel to a metering chamber which also includes a diaphragm. The metering chamber serves the same purpose as a float controlled fuel chamber in carburetors used with engines intended to operate at a stable attitude or position. The metering chamber meters fuel to both a high speed circuit and a low speed circuit from which fuel is fed to a mixing chamber. The diaphragm fuel pump is actuated in response to crankcase pressures which fluctuate between sub-atmospheric and super-atmospheric pressures. As a consequence, the speed of the engine determines the amount of fuel flow which is supplied by the pump. Since the speed of the engine varies between idle speeds of approximately three-thousand rpm's to high speed, to the order of eight-thousand rpm's or more, a large amount of fuel must be supplied for high speed operation. The metering chamber must be very sensitive to meter the correct amount of fuel to the mixing chamber of the carburetor. Usually the metering chamber employs a diaphragm which reacts to the pressure of fuel at one side to move and operate a fuel inlet valve. The diaphragm must bevery sensitive to changes in pressure and must operate in all positions of the system to meter the appropriate amount of fuel. Such devices are difficult to control particularly at low speeds when low volumes of fluid are being delivered. The problem becomes particularly acute when the engine is operating at high speed and it is desired to reach an idle speed as rapidly as possible. Such a condition occurs, for example, when a chain saw is being operated under load conditions and a saw cut is completed. At that time the load on the engine is relieved and the engine begins to operate at a maximum speed. The operator under such conditions will move the throttle to a closed or idle position. Unless the metering chamber can react very rapidly, fuel continues to be fed to the high speed circuit so that even though the throttle is closed, excess fuel is being fed to the mixing chamber which causes a flooding resulting in stalling of the engine. The engine must then be restarted and because of the flooded condition starting usually is difficult.

It is the object of the invention to provide a small compact carburetor and fuel feed system for use with power tools such as chain saws in which provision is made for instantaneous deceleration of the enging from high speed to low speed without flooding the engine.

Another object of the invention is to provide a carburetor and fuel supply apparatus which incorporates high and low speed fuel delivery circuits and in which the high speed circuit will be instantaneously closed when the throttle is closed for low speed operation.

Still another object of the invention is to provide a combined carburetor and fuel supply system which elimates the need for a float type chamber, a diaphragm type fuel metering chamber or a pressurized injection system and in which fuel is delivered to the degree required for the speed of operation of the engine and any excess is returned to the fuel tank.

An additional object of the invention is to provide a carburetor and fuel supply system which incorporates high and low speed fuel delivery circuits and in which the low speed circuit will be closed and remain closed whenever the engine is not operating.

It is another object of the present invention to provide a combined carburetor and fuel supply system which eliminates the need for a float type fuel chamber or diaphragm type fuel metering chamber and in which fuel is delivered to the degree required for the speed of operation of the engine and any excess is returned to the fuel tank.

Another object of the invention is to provide a combined carburetor and fuel supply system in which closing of the carburetor throttle valve when the engine is operating at high speed, closes off any further fuel delivery to the high speed circuit to prevent flooding of the carburetor and results in an immediate return of the engine to idle speed.

The combined carburetor and fuel supply system of the present invention incorporates a diaphragm operator pump which pumps fuel from a fuel supply tank to a return line to the tank and in which the return line is maintained full of fuel at a very low pressure and in which the high speed and low speed metering circuits of a carburetor extract the required amount of fuel from the fuel line between the outlet of the pump and the tank with any excess fuel not required by the engine being returned directly to the fuel tank. The carburetor also includes a control mechanism in the high speed circuit which is operative in all positions of the engine and its attached carburetor to close off the supply of fuel to the high speed circuit when the operator signals a demand to drop the engine speed from full speed to idle speed so that flooding and stalling of the engine is avoided. Also, the low speed circuit includes a mechanism automatically shutting off any delivery of fuel from the return line to the carburetor when the engine is not running to avoid fuel leakage and flooding of the carburetor.

Figures 1, 2, 3:
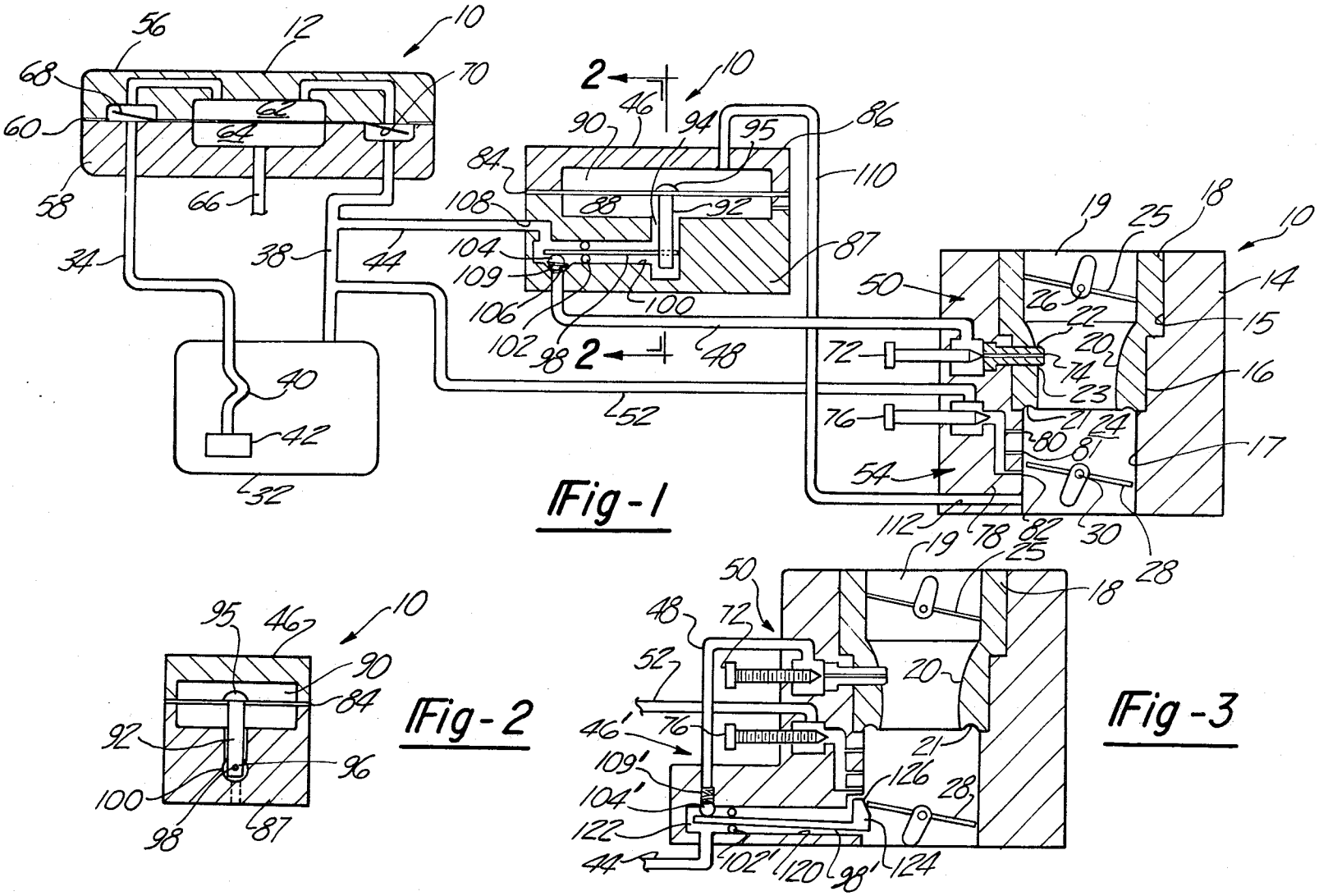
FIG. 1 is a diagrammatic view of the carburetor and fuel feed apparatus embodying the present invention.
FIG. 2 is a view taken generally on line 2—2 in FIG. 1.
FIG. 3 is a diagrammatic view showing another embodiment of the invention.

The carburetor and fuel supply system embodying the present invention is incorporated in a single body portion 10 which in the drawings is depicted by separate housing portions. Incorporated within the body portion 10 are a fuel pump 12 and a carburetor section 14 by which fuel is supplied to the carburetor to be mixed with air and delivered to the crankcase of an engine such as a two cycle engine, for example, on which the housing 10 is adapted to be mounted.

The present invention is particularly concerned with engines of the type used on chain saws which must operate in various positions including a fully inverted position.

In two cycle engines, air and fuel is drawn through the carburetor into the crankcase of the engine and during the compression stroke, the mixture of air and fuel is bled from the engine crankcase into the engine cylinder. The pressure of gases within the crankcase of the engine undergoes a change from sub-atmospheric or vacuum pressure to pressure above atmospheric. These pressure fluctuations are utilized for operating the pump section 12 of the combined carburetor and fuel supply system of the present invention.

The carburetor section 14 of the apparatus includes a stepped bore in a form of a relatively large diameter bore 15, an intermediate bore 16 and a small bore 17 which merge with each other. The bores 15 and 17 receive a venturi fitting 18, which is generally tubular in configuration. The interior of the fitting 18 forms a passage which has a relatively large opening 19 at one end merging with a restricted passage or venturi portion indicated at 20. The lower portion of the fitting 18, as viewed in the drawings protrudes radially from the walls of the bore 17 and is undercut as indicated at 21 to form a groove facing axially toward one end of the bore 17. The fitting 18 is held in position in the bore portions 15 and 16 by means of a fuel nozzle 22 which is threaded into the walls of the housing 10 to project through a radial opening 23 in the fitting 18. The nozzle 22 prevents accidental removal of the venturi fitting 18 from the housing 10. The venturi fitting 18 and the bore portion 17 in the housing 10 form a fuel and air mixing passage 24 by which air enters at the opening 19 and is delivered to the open end of the bore 17 which communicates with the intake manifold of the engine. The venturi portion 20 serves to create a low pressure effect during air flow due to the restriction of the venturi portion, and the undercut portion 21 tends to restrict the back flow of a mixture of air and fuel against the stream of incoming air, particularly at high operational speeds of the engine.

The venturi fitting 18 can be removed and replaced by another venturi fitting having different interior configurations and different sized venturi portion 20 to accommodate different types of engines with different types of operating characteristics without requiring changes in the remaining portion of the carburetor.

Mounted within the relatively large opening 19 of the venturi fitting 18 at the upstream side of the venturi fitting 20 is a conventional choke valve 25 of the butterfly type which is mounted for rotation with a shaft 26. The shaft 26 is rotatable in the walls of the venturi fittings 18 and housing portion 10 adjacent the carburetor section 14. At the opposite, or downstream side of the venturi restriction 20, and in the small bore portion 17, is a conventional butterfly type throttle valve 28 which is mounted on a shaft 30 rotatably journaled in the walls of the housing 10.

Fuel for operating the engine is stored in a tank 32 and is pumped therefrom through a line 34 to the pump 12 which delivers the fuel to a line 38 returning to the tank 32. Disposed within the fuel tank 32 is a fuel inlet tube 40, the free end of which is provided with a fuel filter 42. The fuel inlet 40 is flexible so that for any position on the tank 32, including an inverted position, the filter 42 remains immersed in fuel so that fuel can be delivered through the hose 40 to the line 34.

A branch line 44 is connected with the fuel return line 38 and is delivered through a control mechanism 46 through a line 48 to a main or high speed fuel metering system indicated generally at 50. A second branch line 52 is connected with the return line 38 for the delivery of fuel from the pump 12 to a low or idle speed metering system indicated generally at 54.

The pump 12 which received fuel from the tank 32 through line 34 and delivers fuel through the line 38 back to the tank 32, to the high speed metering system 50 or the low speed metering system 54 is of the diaphragm type. The pump 12 includes a pair of housing portions 56 and 58 forming part of the housing 10. A diaphragm 60 is sandwiched between the housing portions 56 and 58 and a portion of the diaphragm is located in a cavity formed in the housing sections 56 and 58 and serves to divide the cavity into a fuel chamber 62 and a pumping chamber 64. The pumping chamber is connected by way of a conduit indicated at 66 to the crankcase of the two cycle engine so that the pressure pulsations created within the crankcase are also created in the pumping chamber 64 causing the diaphragm 60 to flex and to pulse. The member forming the diaphragm 60 also forms an inlet valve 68 and an oultet valve 70. The inlet valve 68 and outlet valve 70 are of the flap type and act as check valves. The flap valves 68 and 70 as well as the diaphragm 60 are formed of a single, unitary sheet member fabricated of an elastomeric or rubberlike material.

The inlet valve 68 controls the entry of fuel to the pump 12 from the line 34 and the outlet valve 70 controls the delivery from the pump 12 to the return line 38. Upon the pulsation of pressure in the pumping chamber 64, the diaphragm 60 flexes to draw fuel from the line 34 through the valve 68 and upon flexing of the diaphragm in the opposite directions fuel is delivered through the valve 70 to the return line 38. For example, when sub-atmospheric pressure exists in the pumping chamber 64, the diaphragm 60 will move downwardly from the position shown in the drawing causing a low pressure in the fuel chamber 62 this causes the flap valve 70 to close and the flap valve 68 to open and to draw fuel from the tank 32 through the line 34 into the chamber 62. When the pressure in the pumping chamber 64 changes to super-atmospheric pressure, the diaphragm 60 will flex upwardly increasing the pressure in the fuel chamber which tends to close the flap valve 68 to prevent fuel return through the line 34 and at the same time the increased pressure opens the flap valve 70 so that fuel is delivered from the chamber 62 to the line 38 and to its connecting branch lines 44 and 52.

Figure 4:
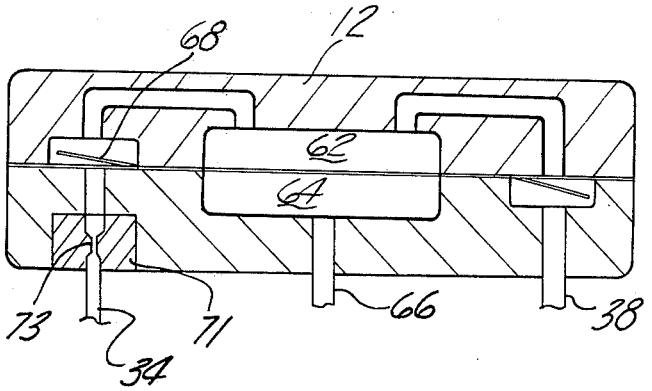
FIG. 4 shows an enlarged view of the pump portion seen in FIG. 1.

Referring now to FIG. 4 the line 34 between the pump 32 and the inlet valve 68 of the pumping section 12 is provided with a restriction portion 71 which serves to form a restricted aperture 73 of a relatively small size when compared with the diameter of the line 34 and with the return line 38. The restricted orifice 73 serves to dampen the effect of pressure fluctuation in the crankcase of the engine transmitted through the conduit 66 to the pumping chamber 64 and more particularly maintains the passages in the pump section 12 downstream from the restricted orifice 73 at a minimum pressure. In actual practice the resultant output pressure of the pump section 12 in the return line 38 is to the order of less than one half psi and is sufficient to maintain the line 38 completely filled with fuel so that fuel is available to the branch lines 44 and 52.

Fuel which is delivered by the pump 12 to the outlet or return line 38 is also made available in the branch lines 44 and 52. The first of the branch lines 44 is connected through the control mechanism 46 to the line 48 and to the high speed metering circuit 50. The high speed metering circuit 50 includes a needle valve 72 which is threaded in the housing 10 so that it may be threadably adjusted to selected positions to vary the effective size of a passage 74 in the nozzle 22 communicating with the mixing passage 24 at the venturi restriction 20. Adjustment of the high speed needle valve 72 controls the amount of fuel delivered during high speed operation of the engine.

The second of the branch lines 52 is connected to the low speed metering portion 54 which includes a needle valve 76 which like the high speed needle valve 72 is threaded in the housing 10 and which may be threadably adjusted to vary the orifice communicating with a fuel manifold portion indicated at 78. The manifold 78 includes a plurality of passages 80, 81 and 82. In the closed position of the throttle valve 28 shown in the drawings, passage 80 opens downstream of the throttle 28 and the passages 81 and 82 communicate upstream of the closed throttle valve. Under such conditions the lower passage 80 draws fuel from the manifold 78 due to the high vacuum existing with the closed throttle valve 28. The other two passages 81 and 82 serve to supply the air requirements for mixing the fuel entering through the passage 80 so that a combustible mixture is formed for delivery to the intake manifold of the engine.

The control mechanism 46 disposed in the high speed fuel delivery lines 44 and 48 includes a flexible diaphragm 84 which is sandwiched between housing section 86 and 87 and divides a cavity into a chamber 88 and a signal chamber 90. A stem 92 extends from a central portion of the diaphragm 84 and is connected thereto in any conventional manner as by a rivet 95. The lower end of the stem 92 projects into a cavity 94 formed in the housing section 87. As best seen in FIG. 2, the stem 92 is provided with a transverse opening 96 which loosely receives one end of a lever 98 which is disposed in a bore 100 communicating with the cavity 94.

An intermediate portion of the lever 98 is provided with an O-ring 102 which sealingly engages the lever 98 as well as the bore 100. The opposite ends of the lever 98 move upwardly and downwardly from the position in which the lever is shown in the drawings in response to flexing of the diaphragm 84 which acts as an actuating means causing the lever 98 to pivot about a fulcrum which is afforded by the O-ring 102.

The free end of the lever 98 moves relative to a ball valve 104 which serves to open and close relative to a conical seat 106 formed in the lower housing section 87 and communicating with the fuel line 48. The lower housing section 87 also is provided with a fuel inlet port 108 which communicates with the branch fuel line 44 and with the bore 100. Fuel which is delivered through the branch line 44 passes through the ball valve 104 which is maintained in an open position by a small spring 109, to the delivery line 48, and to the high speed metering portion of the carburetor 14. When the ball valve 104 is closed on its seat 106 under the influence of the action of the lever 98, the supply of fuel is terminated.

The signal chamber 90 of the control mechanism 46 communicates by way of a conduit 110 to a passage 112 which opens into the mixing passage 24 downstream of throttle valve 28. The chamber 88 formed at the opposite side of the diaphragm 84 is in continuous communication with the atmosphere. Atmosphere pressure also will exist in the various cavities surrounding the stem 92 and in the bore 100 at the right side of the O-ring 102 as seen in the drawing. Fuel entering through the line 44 and passing to the line 48 will exist in the cavities formed to the left of the O-ring 102. The O-ring serves as a seal separating the fuel at one side from atmospheric air at the other side and in addition serves as a pivot or fulcrum for the lever 98.

The small spring 109 which is disposed between the ball 104 and the conical seat 106 insures that the ball 104 will become unseated to permit the passage of fuel when the lever 98 has been pivoted in a clockwise direction as viewed in the drawing. During usual operations of the carburetor, the free end of lever 98 is spaced sufficiently from the valve seat 106 so that the ball 100 may remain in an open position to permit full delivery of fuel from the line 44 to the line 48.

Referring now to the embodiment of the invention shown in FIG. 3, a control mechanism 46′ is employed instead of the control mechanism 46 shown in the arrangement in FIG. 1. The control mechanism 46′ is disposed in the housing 10 to receive fuel from the line 44 and to deliver fuel to the line 48 to the high speed metering system 50. The control mechanism 46′ includes a ball valve 104′ which is urged to an open position by a spring 109′. The ball valve 104′ is moved to a closed position on a seat 106′ by means of a lever 98′. The lever 98′ is adapted to pivot about an O-ring 102′. The lever 98′ is disposed in an elongated chamber 120 and the O-ring 102′ has its outer diameter in sealing engagement with the walls of the chamber 120 and the inner diameter of the O-ring is in engagement with the lever 98′. The O-ring 102′ not only acts as a pivot for the lever 98′ but also acts to seal the chamber 120 below the O-ring as viewed in FIG. 3 from the chamber 122 above the O-ring 102′.

The lower end of the lever 98′ as viewed in FIG. 3, is provided with a cam arm 124 which projects into the small bore portion 17 of the fuel and air mixing passage 23. The cam arm 124 is provided with a cam surface 126 which is adapted to be engaged by the throttle valve 28 when the latter is in its closed position, as shown in FIG. 3, to act as an actuating means and pivot the lever 98′ in a clockwise direction relative to the pivot formed by the O-ring 102′. It will be understood that the cam arm 124 is relatively short and that the passage 120 is disposed in close proximity to the fuel air mixing passage 23. However, in the interest of clarity passage 120 has been shown displaced a substantial distance to one side of the fuel air mixing passage 23.

In the open position of the throttle valve 28, the latter is out of engagement with cam surface 126 and the spring 109′ is of sufficient strength to act on the ball valve 104′ and on the upper end of the lever 98′ to pivot the latter in a counter-clockwise direction permitting the valve 104′ to unseat from the conical seat 106′ and permit the delivery of fuel from the line 44 to line 48 and to the high speed metering circuit 50.

Figure 5:
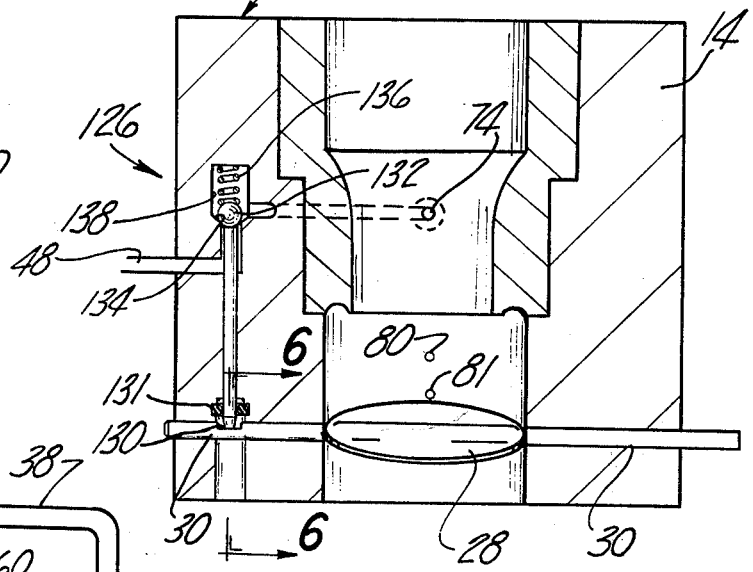
FIG. 5 is a view similar to FIG. 3 showing another arrangement for closing the high speed circuit.

Another form of control mechanism 126 to shut off the high speed metering circuit is shown in FIG. 5. The mechanism is disposed in the housing 10 to respond to movement of the throttle valve 28 to its closed position.

Figure 6:
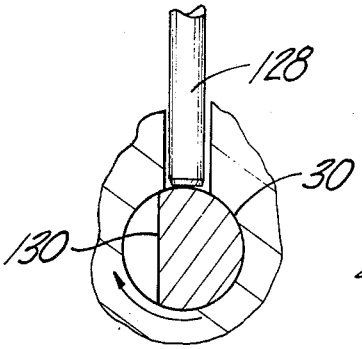
FIG. 6 is an enlarged view taken generally on line 6—6 in FIG. 5.

The control mechanism 126 includes a plunger 128, one end of which engages the shaft 30 of the throttle valve. As seen in FIG. 6, the shaft 30 is provided with an indentation or cutaway portion 130 which interrupts the outer surface on which the stem or plunger 128 rests when the throttle valve 28 is an open position. The lower end of the plunger is provided with an O-ring seal 131 and the upper end of the plunger engages a ball 132 which is adapted to seal on a conical seat 134. The ball 132 is urged downwardly into engagement with seat 134 by means of a spring 136 disposed in a cavity 138. The annular, conical seat 134 is formed in the line 48 of the high speed metering circuit. In an open position of the throttle valve 28, the plunger 128 rests on the outer surface of the shaft 30 as seen in FIG. 6 to urge the ball 132 off its seat 134 and permits fluid flow through line 48 to outlet 74. When the throttle 28 is moved to its closed position the spring 136 urges the ball 132 and therefore the stem 128 downwardly into engagement with the indentation 130 so that the ball 132 closes seat 134 to the flow of fuel in the line 48.

Figure 7:
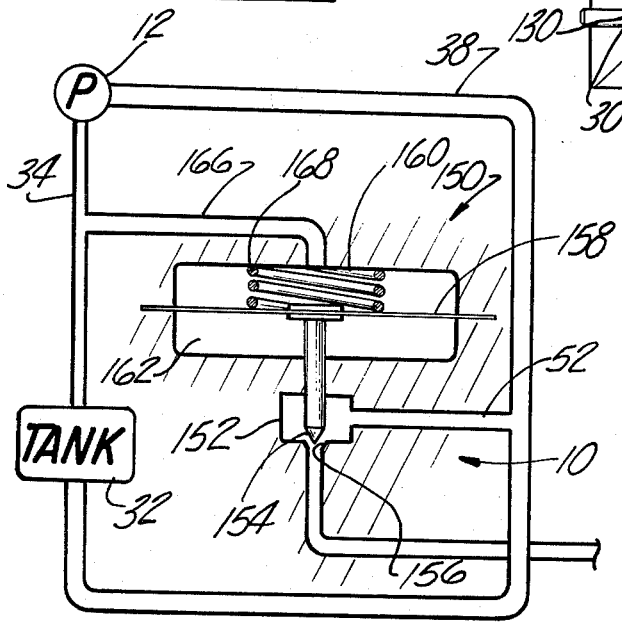
FIG. 7 is a diagrammatic view showing a modification of the low speed circuit seen in FIG. 1.

Referring now to FIG. 7, a form of idle meter circuit control mechanism 150 is shown and may be employed with the carburetor and fuel fed apparatus of the present invention. The control mechanism 150 is disposed in the housing 10 and includes a shut off valve 152 which includes a valve closure element 154 movable into and out of engagement with the valve seat 156 for the purpose of opening and closing the line 52 communicating the return line 38 with the low or idle circuit.

A valve closure element 154 is connected to a diaphragm 158 having its peripheral edges clamped in the housing 10 to form a chamber 160 at one side of the diaphragm 158 and a chamber 162 at the opposite side of the diaphragm. The chamber 160 communicates by way of the line 166 with the intake line 34 between the fuel tank 32 and the pump section 12. A spring 168 is disposed in the chamber 160 and acts on the upper side of the diaphragm 158 to urge the valve closure element 154 into engagement with its complementary seat 156 at such times as the engine and therefore the fuel system are not in operation. When the engine is in operation so that the pump section 12 is operating to draw fuel from the tank 32, a negative pressure is established in the chamber 160 so that atmospheric pressure in the chamber 162 is effective to overcome the spring 168 to urge the valve closure 154 upwardly out of engagement with the seat 156. In such an open position fuel is free to flow from the return 38 to the line 52 and into low speed metering circuit. The shut off valve 152 will remain open during all times that the engine is operating because of the continuous establishment of negative pressure in the chamber 160. As soon as the engine stops, the pumping chamber 64 will no longer be subjected to pulsations and the pump section 12 will cease to operate to permit the chamber 160 to return to a normal pressure so that the spring 168 becomes effective to move the valve plunger 154 downwardly to close on the seat 156 to prevent any further delivery of fuel to the line 52. In this manner the low speed circuit 152 is completely shut off at all times that the engine is not operating to prevent any leakage of fuel into the mixing passage 24 of the carburetor section.

Referring to the embodiment of the invention shown in FIGS. 1 and 2, with the choke valve 25 in an open position, movement of the throttle valve 28 to an open position will cause air to flow rapidly in the passage 24 in response to vacuum at the engine intake manifold. At the venturi restriction 20, the airflow will provide a low pressure region so that fuel in the line 48, which is under a relatively higher pressure, will be delivered through the high speed fuel passage 74. The optimum amount of fuel for high speed engine operation is obtained by adjustment of the needle valve 72.

When the engine is being operated at lower speeds with the throttle fully or partially closed the pressurized fuel in line 52 will be delivered by way of one of the passages 80, 81 and 82 of the manifold 78 due to the low pressure area in the fluid passage 16. Under either condition, that is high or low speed operation, any fuel which is not pulled into the line 48 or line 52 is returned to the tank 32 by way of the line 38 so that the high speed circuit 50 and the low speed metering circuit 54 are supplied only with the required amount of fuel and the reaminder, if any, is returned to the tank 32.

When the engine is being operated at full speed the choke 25 and throttle 28 will be in their fully open position permitting the maximum passage of air and fuel to the engine manifold. This is a condition that could exist during a saw cut. Under these circumstances if the throttle valve 28 is suddenly closed, for example, upon completion of the saw cut, a maximum vacuum condition will be created at the downstream side of the throttle valve 28. This vacuum pressure is communicated through the line 110 to the signal chamber 90 associated with the diaphragm 84 in the control mechanism 46. This causes a differential of atmospheric pressure at the underside of the diaphragm 84 and a vacuum pressure at the opposite side of the diaphragm which causes it to move upwardly from the position seen in the drawings, carrying the stem 92 upwardly. Upward movement of the stem 92 causes the lever 98 to pivot about the O-ring 102 in a counter-clockwise direction as seen in the drawings to bring the free end of the lever 98 downwardly and into engagement with the ball valve 104. The ball valve 104 is moved downwardly against the action of the light spring 109 to seat on the conical seat 106 and to close off the delivery of fuel to the line 48.

With the ball valve 104 closed, fuel cannot be delivered to the high speed metering circuit 50. However, fuel continues to be delivered through the branch line 52 to the low speed metering circuit 54 for operation of the engine at a low or idle speed. By instantly closing off the fuel supply line 44, 48 to the high speed metering circuit 50, when the throttle valve is closed during high speed operation no additional means are required to dry the fuel mixing chamber 24 and flooding when decelerating from high speed to low speed is eliminated. Moreover, in any position of the combined carburetor and fuel delivery device for example, in a completely inverted position, the controlled diaphragm 84 operates to close the ball valve 104. The diaphragm 84 can be of a relatively small size since the effect of differential pressure acting thereon is being magnified mechanically through the lever 98 so that a relatively large force is applied to the ball valve 104 to maintain it in a closed position on its seat 106.

Referring now to the embodiment of the invention shown in FIG. 3, the operation is generally similar to that shown in FIG. 1, in that the ball valve 104' is controlled to permit the delivery of fuel from the line 44 to the line 48 or to prevent such delivery when the ball valve 104 is closed on its seat 106'.

During normal operation of the carburetor with the throttle valve 28 in an open position, the spring 109' serves to move the ball valve 104' from its seat 106' to permit open communication between the line 44 to the line 48 for delivery of fuel to the high speed metering circuit 50.

When the throttle valve 28 is moved to a closed position, the edge of the throttle valve 28 engages the cam surface 126 to pivot the arm 98' in a clockwise direction bringing the upper end of the lever 98' into engagement with the ball valve 104'. Such movement of the lever 98' closes the ball 104' on the conical seat 106' against the action of the spring 109' and prevents further delivery of fuel from the line 44 to the line 48. With the delivery of fuel to the high speed circuit 50 interrupted, fuel continues to be delivered through the branch line 52 and the low speed metering circuit 54 for operation of the engine at a low or idle speed. The instant closing off of the fuel supply line 44, 48 to the high speed metering circuit 50, when the throttle valve is closed, prevents flooding particularly when decelerating the engine from a high to a low speed. Furthermore, in any position of the carburetor and fuel delivery device, the ball valve 104' is positively closed upon movement of the throttle valve 28 to its closed position.

It will be noted that in the embodiment of the invention shown in FIG. 3, closing of the throttle valve is effective to close the fuel delivery line 44, 48 at all times whether or not the engine is operating. Similarly, with the arrangement shown in FIG. 5, closing of the throttle valve 28 causes the shaft 30 to be rotated so that the valve stem 132 is moved upwardly to close on the seat 140 to prevent delivery of fuel from the line 48.

When operated with the arrangement shown in FIG. 6, the low speed line 52 will deliver fuel from the return line 38 to the carburetor section at such times that the engine is operating and as soon as the engine stops the valve 152 will close off the further delivery of fuel to prevent leakage from the return line 38 through the line 52 to the carburetor section.

A carburetor and fuel supply system have been provided in which an engine operating at high speed requiring a high volume of fluid may be almost instantaneously decelerated to a low, idle speed at which only a low volume of fuel is required. The rapid deceleration from high to low speed is accomplished without the usual flooding condition by employing a control which instantly and completely closes off fuel being delivered to the high speed circuit of the carburetor in response to closing of the carburetor throttle valve to its low or idle speed position, after which fuel is delivered solely to the low speed circuit. Such operation occurs for all positions of the carburtor. The carburetor and fuel supply system is such that the full range of fuel volume required between high and low speed operations are accommodated by carburetor and fuel supply system which receives fuel from a supply and delivers the required amounts to a high speed circuit of a carburetor section and to the low speed section with any excess fuel not required by the carburetor section being returned directly to the supply of fuel. The low speed section is provided with a shut off arrangement which responds to vacuum pressure or suction produced when the pumping section is in operation to maintain a valve in an open position for the delivery of fuel to the carburetor section and as soon as the engine stops the valve shuts to prevent leakage of fuel into the carburetor section. The carburetor employs a replaceable venturi section by which different performnce characteristics, may be obtained to accommodate different engines with different operating characteristics and in which the venturi section incorporates an undercut portion which tends to restrict the back flow of fuel air mixture in the mixing chamber during high speed operation.

The embodiments of the invention in which an exclusive property or privilege is claimed are defined as follows:

1. A fuel supply system for operating an engine in various positions, including an inverted position, comprising; a housing, a mixing passage in said housing for supplying a mixture of fuel and air to the engine, a throttle valve in said passage for controlling the supply of air and fuel mixture to the engine, a pump having an inlet and an outlet, said inlet being connected to a source of fuel for receiving fuel therefrom, a return conduit connected to said outlet and to said source for returning fuel from said pump to said source, means operatively associated with said inlet for restricting fuel flow to said outlet to maintain fuel pressure at said outlet less than the pressure upstream from said inlet, a main metering system communicating with said return conduit and said mixing passage to deliver fuel for operating the engine in a high speed range, an idle metering system communicating with said return conduit to supply fuel to the mixing passage downstream from the throttle valve for operating the engine in the idle speed range, and valve means in said main metering system responsive when said pump is not operating to close said main metering system, a valve in said idle metering system movable between open and closed positions, and control means responsive to pressure upstream from said inlet to open and responsive to the absence of pressure to close said valve.

2. The combination of claim 1 in which said control means includes a diaphragm forming a pair of chambers in said housing, one of said chambers communicating with said inlet and the other of said chambers communicating with the atmosphere.

3. The combination of claim 2 and further comprising means biasing said diaphragm to a position closing said valve.

4. A fuel supply system for operating an engine comprising; a housing, a mixing passage formed in said housing for supplying a mixture of fuel and air to the engine, a throttle valve in said passage for controlling the supply of air and fuel mixture to the engine, a pump having an inlet communicating with a source of fuel, said pump having an outlet communicating with and returning fuel to said source, means operatively associated with said inlet to restrict said inlet to maintain pressure of fuel delivered by said pump to said outlet to a minimum, a main metering system communicating with said outlet for operating the engine in a high speed range, an idle metering system communicating with said outlet to supply fuel to the mixing passage downstream from the throttle valve for operating the engine in the idle speed range, a first valve means in said main metering system movable between positions opening and closing the supply of fuel from said outlet to said mixing passage, a second valve means in said idle metering system movable to open and close the supply of fuel from said outlet to said mixing passage, first control means operable upon movement of said throttle valve to its closed position to move said first valve means to its said closed position, and second control means operable to close said second valve means when said pump is not operating to prevent delivery of fuel to said mixing passage.

5. The combination of claim 4 in which said outlet communicating to said source is larger than said inlet to reduce pressure delivered by said pump to said outlet.

6. The combination of claim 4 wherein said outlet communicates with said source through the return line, said main metering system and idle metering system being in communication with said return line.

7. The combination of claim 4 in which said main metering system is connected to said return line between said outlet and said fuel supply and in which said idle metering system is connected to said return line between said main metering system and said supply.

8. The combination of claim 4 in which said first valve means is normally disposed in an open position and in which said control means is operable to move said valve means to a closed position.

9. The combination of claim 8 in which said control means includes an element engagable with said throttle and with said first valve means and being movable in response to movement of said throttle to a closed position to close said valve means.

10. The combination of claim 9 in which said throttle valve includes a rotatable shaft supporting said throttle valve and in which said element is engaged with said rotatable shaft.

11. The combination of claim 4 in which said second control means includes a pressure sensing mechanism responsive to pressure at said inlet to move said second valve means.

12. The combination of claim 4 in which said second control means includes a diaphragm forming a pair of chambers in said housing, one of said chambers communicating with said inlet and the other of said chambers communicating with the atmosphere.

13. The combination of claim 12 and further comprising a spring biasing said diaphragm to a position closing said second valve means.

* * * * *

UNITED STATES PATENT OFFICE

CERTIFICATE OF CORRECTION

Patent No. 4,055,609 Dated October 25, 1977

Inventor(s) Harold E. Phelps

It is certified that error appears in the above-identified patent and that said Letters Patent are hereby corrected as shown below:

Following References Cited, Attorney, Agent, or Firm - Fisher, Gerhard & Groh should read -- Fisher, Gerhardt & Groh--

Column 1, lines 2 and 3, cancel "now abandoned".

Column 1, line 39, "bevery" should read --be very--

Column 1, line 62, "enging" should read --engine--

Signed and Sealed this

Twenty-third Day of May 1978

[SEAL]

Attest:

RUTH C. MASON
Attesting Officer

LUTRELLE F. PARKER
Acting Commissioner of Patents and Trademarks